US009906884B2

(12) United States Patent
Meshram et al.

(10) Patent No.: US 9,906,884 B2
(45) Date of Patent: Feb. 27, 2018

(54) METHODS, SYSTEMS, AND COMPUTER READABLE MEDIA FOR UTILIZING ADAPTIVE RECTANGULAR DECOMPOSITION (ARD) TO GENERATE HEAD-RELATED TRANSFER FUNCTIONS

(71) Applicant: The University of North Carolina at Chapel Hill, Chapel Hill, NC (US)

(72) Inventors: Alok Namdeo Meshram, Seattle, WA (US); Dinesh Manocha, Chapel Hill, NC (US); Ravish Mehra, Chapel Hill, NC (US); Enrique Dunn, Chapel Hill, NC (US); Jan-Michael Frahm, Chapel Hill, NC (US); Hongsheng Yang, Sunnyvale, CA (US)

(73) Assignee: The University of North Carolina at Chapel Hill, Chapel Hill, NC (US)

( * ) Notice: Subject to any disclaimer, the term of this patent is extended or adjusted under 35 U.S.C. 154(b) by 0 days.

(21) Appl. No.: 15/225,505

(22) Filed: Aug. 1, 2016

(65) Prior Publication Data

US 2017/0034641 A1 Feb. 2, 2017

Related U.S. Application Data

(60) Provisional application No. 62/199,880, filed on Jul. 31, 2015.

(51) Int. Cl.
*H04S 7/00* (2006.01)

(52) U.S. Cl.
CPC ..... *H04S 7/303* (2013.01); *H04S 7/00* (2013.01); *H04S 2420/01* (2013.01)

(58) Field of Classification Search
CPC .. H04S 2420/01; H04S 7/303; H04S 2400/15; H04S 7/00; G06T 17/20
See application file for complete search history.

(56) References Cited

U.S. PATENT DOCUMENTS 6,664,956 B1 * 12/2003 Erdem ..... G06T 17/20 345/419
2004/0236552 A1 * 11/2004 Pieper ..... G06F 17/5018 703/6

(Continued)

OTHER PUBLICATIONS

Ackerman et al., "Acoustic Absorption Coefficients of Human Body Surfaces," Technical Documentary Report No. MRL-TBR-62-36, Biomedical Laboratory, Air Force Base, p. 1-25 (Apr. 1962).

(Continued)

*Primary Examiner* — Mohammad Islam
(74) *Attorney, Agent, or Firm* — Jenkins, Wilson, Taylor & Hunt, P.A.

(57) ABSTRACT

Methods, systems, and computer readable media for utilizing adaptive rectangular decomposition (ARD) to perform head-related transfer function (HRTF) simulations are disclosed herein. According to one method, the method includes obtaining a mesh model representative of head and ear geometry of a listener entity and segmenting a simulation domain of the mesh model into a plurality of partitions. The method further includes conducting an ARD simulation on the plurality of partitions to generate simulated sound pressure signals within each of the plurality of partitions and processing the simulated sound pressure signals to generate at least one HRTF that is customized for the listener entity.

17 Claims, 4 Drawing Sheets

(56) References Cited

U.S. PATENT DOCUMENTS

2005/0256686 A1* 11/2005 Stabelfeldt ..... G06F 17/5018 703/6
2007/0188710 A1* 8/2007 Hetling ..... A61B 5/0496 351/221
2010/0049450 A1* 2/2010 Nagakubo ..... G01L 5/228 702/41
2015/0123967 A1* 5/2015 Quinn ..... G06T 13/40 345/420
2016/0325505 A1* 11/2016 Ou ..... B29C 67/0088

OTHER PUBLICATIONS

Agarwal et al., "Building Rome in a Day," Proceedings of the 2009 IEEE Internation Conference on Computer Vision, Communications of the ACM, vol. 54, No. 10, pp. 105-112 (Oct. 2011).
Algazi et al., "Elevation localization and head-related transfer function analysis at low frequences," J. Acoust. Soc. Am., 109(3), 1110-1122 (Mar. 2001).
Algazi et al., "Approximating the head-related transfer function using simple geometric models of the head and torso," The Journal of the Acoustical Society of America, 112(5), pp. 2053-2064 (Nov. 2002).
Algazi et al., "The CIPIC HRTF database," Applications of Signal Processing to Audio and Acoustics, 2001 IEEE Workshop, pp. 1-4 (Oct. 2001).
Begault, "3-D Sound for Virtual Reality and Multimedia," National Aeronautics and Space Administration, Academic Press, pp. 1-232 (2000).
Bilinski et al., "HRTF magnitude synthesis via sparse representation of anthropometric features," ICASSP, pp. 1-6 (2014).
Brungart et al., "Auditory localization of nearby sources, head-related transfer functions," The Journal of the Acoustical Society of America, 106, pp. 1956-1968 (1999).
Duda et al., "Range dependence of the response of a spherical head model," The Journal of the Acoustical Society of America, 104(5), pp. 3048-3058 (Nov. 1998).
Forsyth et al., "Computer vision: a modern approach," Prentice Hall Professional Technical Reference, pp. (2002).
Frahm et al., "Building rome on a cloudless day," ECCV, pp. 368-381 (2010).
Gallup et al., "Variable baseline/resolution stereo," Computer Vision and Pattern Recognition, 2008, CVPR 2008, IEEE Conference, pp. 1-8 (2008).
Gallup et al., "Real-time plane-sweeping stereo with multiple sweeping directions," Computer Vision and Patter Recognition, 2007, CVPR'07, pp. 1-8 (2007).
Gallup et al., "3d reconstruction using an n-layer heightmap," Pattern Recognition, Springer, pp. 1-10 (2010)
Green, "Spherical Harmonic Lighting: The Gritty Details," Archives of the Game Decelopers Conference, 35 pgs (Mar. 2003).
Gumerov et al., "Computation of the head-related transfer function via the fast multipole accelerated boundary element method and its spherical harmonic representation," J. Acoust. Soc. Am., 127(1), pp. 370-386 (Jan. 2010).
Hartley et al., "Multiple View Geometry in computer vision," Cambridge university press, second edition, pp. 1-655 (2003).
Hirschmuller ,"Stereo processing by semiglobal matcing and and mutual information," Pattern Analysis and Machine Intelligence, IEEE Transactions, 30(2), pp. 328-341 (Feb. 2008).
Hu et al., "HRTF personalization based on artificial neural network in individual virtual auditory space," Applied Acoustics, 69(2), pp. 163-172 (2008).
Jancosek et al., "Multi-view reconstruction preserving weakly-supported sufaces," IEEE Conference on Computer Vision and Pattern Recognition (CVPR), pp. 3121-3128 (2011).
Jo et al., "Signal processing: Aproximation of head related transfer function using prolate spheroidal head model," ICSV15, 15th International Congress on Sound and Vibration, pp. 1-8 (Jul. 2008).
Kahana et al., "Boundary element simulations of the transfer function of human heads and baffled pinnae using accurate geometirc models," Journal of sound and vibration, 300(3), pp. 552-579 (2007).
Katz et al., "Round robin comparison of hrtf measurement systems: preliminary results," Proc. 19th Intl. Congress on Acoustics (ICA2007), Madrid, Spain, pp. 1-4 (2007).
Langendijk et al., "Contribution of spectral cues to human sound localization," J. Acoust. Soc. Am., 112(4), pp. 1583-1596 (Oct. 2002).
Larsson et al., "Auditory-induced presence in mixed reality environments and related technology," The Engineering of Mixed Reality Systems, Springer, pp. 1-23, (2010).
Lowe, "Distinctive image features from sale-invariant keypoints," Int. J. Comput. Vision, 60(2), pp. 1-28 (Nov. 2004).
Ma et al., "An Invtation to 3-D Vision: from images to models," vol. 26, Springer, pp. 1-325 (Nov. 2001).
Mehra et al., "Source and Listener Directivity for Interactive Wave-Based Sound Propagation," Visualization and Computers Graphics, IEEE Transactions, 20(4), pp. 1-9 (Apr. 2017).
Mehra et al., "An Effcient GPU-based Time Domain Solver for the Acoustive Wave Equation," Applied Acoustics, 73(2), pp. 1-13 (2012).
Mei et al., "On Building an Accurate Stereo Matching System on Graphics Hardware," Computer Vision Workshops (ICCV Workshops), 2011 IEEE International Conference, pp. 1-8 (2011).
Merrell et al., "Real-Time Visibility-Based Fusion of Depth Maps," Computer Vision, 2007, ICCV 2007, IEEE 11th International Conference, pp. 1-8 (2007).
Meshram et al., "Efficient HRTF Computation using Adaptive Rectangular Decomposition," Audio Engineering Society Conference: 55th International Conference: Spatial Audio, Audio Engineering Society, pp. 1-8 (2014).
Middlebrooks et al., "Sound Localization by Human Listeners," Annu. Rev. Psychol. 42(1), pp. 135-159 (1991).
Mokhtari et al., "Computer Simulation of HRTFs for Personalization of 3D Audio," Universal Communication, 2008, ISUC'08, Second International Symposium, pp. 435-440 (2008).
Morales et al., "A parallel ARD-based wave simulator for distributed memory architectures," Technical report, Department of Computer Science, UNC Chapel Hill (2014).
Newcombe et al., "DTAM: Dense Tracking and Mapping in Real-Time," Computer Vision (ICCV), 2011 IEEE International Conference, pp. 1-8 (2011).
Oliva et al., "Modeling the Shape of the Scene: A Holistic Representation of the Spatial Envelope," Internatinoal Journal of Computer Vision 42(3), pp. 145-175 (2001).
Pec et al., "Personalized head related transfer function measurement and verification through sound localization resolution," Proceedings of the 15th European Signal Processing Conference, pp. 2326-2330 (2007).
Pierce, "Acoustics, An Introduction to Its Physical Principles and Applications," Acoustical Society of America (1989).
Pradeep et al., "MonoFusion: Real-time 3D Reconstruction of Small Scenes with a Single Web Camera," Mixed and Augmented Reality (ISMAR), 2013 IEEE International Symposium, pp. 1-6 (2013).
Rafaely et al., "Interaural cross correlation in a sound field represented by spherical harmonics," The Journal of the Acoustical Society of America, 127(2), pp. 823-828 (2010).
Raghuvanshi et al., "Efficient and Accurate Sound Propagation Using Adaptive Rectangular Decomposition," IEEE Transactions on the Visualization and Computer Graphics, vol. 15, No. 5, pp. 789-801 (Sep./Oct. 2009).
Ramahi, "Near- and Far-Field Calculations in FDTD Simulations using Kirchhoff Surface Integral Representation," IEEE Transactions on Antennas and Propagation, vol. 45, No. 5, pp. 753-759 (May 1997).
Rayleigh, "On our preception of sound direction," Philosophical Magazine Series 6, 13:74, pp. 214-232 (1907).
Seitz et al., "A Comparison and Evaluation of Multi-View Stereo Reconstruction Algorithms," Computer Vision and Pattern Recognition, 2006 IEEE Computer Society Conferences, vol. 1, pp. 1-8 (Jun. 2006).

(56) References Cited

OTHER PUBLICATIONS

Shilling et al., Virtual Auditory Displays, Handook of Virtual Environment Technology, K. Stanney (ed), Lawerence Erlbaum, Associates, Inc., pp. 1-42 (2000).
Snavely, "Bundler: Structure from motion (sfm) for unordered image collections," https://www.cs.cornell.edu/~snavely/bundler/, pp. 1-3, accessed from waybackmachine (Jul. 16, 2015).
Tang et al., "Numerical calculation of the head-related transfer functions with chinese dummy head," Signal and Information Processing Association Annual Summit and Conference (APSIPA), 2013 Asia-Pacific, pp. 1-4 (2013).
Wenzel et al., "Localization using nonindividualized head-related transfer functions," J. Acoust. Soc. Am., 94(1), pp. 111-123 (Jul. 1993).
Wightman et al., "Headphones simulation of free-field listening. I:Stimulus synthesis," J. Acoust. Soc. Am., 85(2), pp. 858-867 (Feb. 1989).
Wightman et al., "Resolution of front-back ambiguity in spatial hearing by listener and source movement," J. Acoust. Soc. Am., 105(5), pp. 2841-2853 (May 1999).
Wu, "Visualsfm: a visual structure from motion system," http://ccwu.me/vsfm/, pp. 1-2 (2011).
Xie et al, "Head-related transfer function database and its analysis," Sci China-Phys Mech Astron, vol. 50, No. 3, pp. 267-280 (Jun. 2007).
Zotkin et al., "HRTF Personalization Using Anthropometric Measurements," Applications of Signal Processing to Audio and Acoustics, 2003 IEEE Workshop, pp. 1-4 (2003).
Zotkin et al., "Rendering Localized Spatial Audio in a Virtual Auditory Space," Perceptual Interfaces and Reality Laboratory, Institute for Advanced Computer Studies, Multimedia, IEEE Transactions, 6(4), pp. 1-29 (2004).
Kahana et al., "Numerical modeling of the transfer functions of a dummy-head and the external ear," AES 16th International Conference on Spatial Sound Rep., Finland, pp. 330-365 (2012).
Katz, "Boundary element method calculation of individual head-related transfer function. i. rigid model calculation," Journal of the Acoustical Society of America, 110(5), pp. 2240-2448 (Nov. 2001).
Katz, "Acoustic absorption measurement of human hair and skin within the audible frequency range," Journal of the Acoustical Society of America, 108 (50), pp. 2238-2242 (Nov. 2000).
Mokhtari et al., "Computer simulation of KEMAR's head-related transfer functions: verifications with measurement and acoustic effects of modifing head shape and pinna concavity," Principles and Applicarions of Spatial Hearing, pp. 205-215 (2011).
Takemoto et al., "Pressure Distribution patterns on the Pinna at Spectral Peak and Notch Frequencies of Head-Related Transfer Functions in the Median Plane," Principles and Applications of Spatial Hearing, pp. 179-194 (2011).
Xiao et al., "Finite difference computation of head-related transfer function for human hearing," Journal of the Acoustical Society of America, 113(5), pp. 2432-2441 (May 2003).

* cited by examiner

400

METHODS, SYSTEMS, AND COMPUTER READABLE MEDIA FOR UTILIZING ADAPTIVE RECTANGULAR DECOMPOSITION (ARD) TO GENERATE HEAD-RELATED TRANSFER FUNCTIONS

PRIORITY CLAIM

This application claims the benefit of U.S. Provisional Patent Application Ser. No. 62/199,880, filed Jul. 31, 2015; the disclosure of which is incorporated herein by reference in its entirety.

GOVERNMENT INTEREST

This invention was made with government support under Grant Nos. IIS-0917040, IIS-1320644, IIS-1349074 awarded by the National Science Foundation and W911NF-10-1-0506, W911NF-12-1-0430, W911NF-13-C-0037 awarded by the U.S. Army Research Office. The government has certain rights in the invention.

TECHNICAL FIELD

The subject matter described herein relates to sound propagation. More specifically, the subject matter relates to methods, systems, and computer readable media for utilizing adaptive rectangular decomposition to generate head-related transfer functions.

BACKGROUND

Three dimensional (3D) Audio Systems often rely on Head-Related Transfer Functions (HRTFs) to add spatial characteristics to auditory images that the audio systems generate. Industrial implementations use "standard" datasets or use mathematical models to generate approximations of HRTFs, which might generate inaccurate spatialization since HRTFs vary from person to person. For this reason, researchers working on spatial sound or psychoacoustics often make physical measurements in an anechoic chamber to generate HRTFs specific to a person. While this produces better results, the process is expensive and time consuming.

Accordingly, there exists a need for systems, methods, and computer readable media for efficiently generating personalized HRTFs at low cost.

SUMMARY

Methods, systems, and computer readable media for utilizing adaptive rectangular decomposition to generate head-related transfer functions are disclosed herein. According to one method, the method includes obtaining a mesh model representative of head and ear geometry of a listener entity and segmenting a simulation domain of the mesh model into a plurality of partitions. The method further includes conducting an ARD simulation on the plurality of partitions to generate simulated sound pressure signals within each of the plurality of partitions and processing the simulated sound pressure signals to generate at least one HRTF that is customized for the listener entity.

A system for utilizing adaptive rectangular decomposition to generate head-related transfer functions is also disclosed. The system includes a preprocessing engine, an ARD simulation engine, and an HRTF engine, each of which are executable by a processor. In some embodiments, the preprocessing engine is configured to obtain a mesh model representative of head and ear geometry of a listener entity and segment a simulation domain of the mesh model into a plurality of partitions. Likewise, the ARD simulation engine is configured to conduct an ARD simulation on the plurality of partitions to generate simulated sound pressure signals within each of the plurality of partitions. Further, the HRTF engine is configured to process the simulated sound pressure signals to generate at least one HRTF that is customized for the listener entity.

The subject matter described herein can be implemented in software in combination with hardware and/or firmware. For example, the subject matter described herein can be implemented in software executed by one or more processors. In one exemplary implementation, the subject matter described herein may be implemented using a non-transitory computer readable medium having stored thereon computer executable instructions that when executed by the processor of a computer control the computer to perform steps. Exemplary computer readable media suitable for implementing the subject matter described herein include non-transitory devices, such as disk memory devices, chip memory devices, programmable logic devices, and application specific integrated circuits. In addition, a computer readable medium that implements the subject matter described herein may be located on a single device or computing platform or may be distributed across multiple devices or computing platforms.

As used herein, the terms "node" and "host" refer to a physical computing platform or device including one or more processors and memory.

As used herein, the terms "function" and "engine" refer to software in combination with hardware and/or firmware for implementing features described herein.

BRIEF DESCRIPTION OF THE DRAWINGS

Preferred embodiments of the subject matter described herein will now be explained with reference to the accompanying drawings, wherein like reference numerals represent like parts, of which.

DETAILED DESCRIPTION

Figure 1:
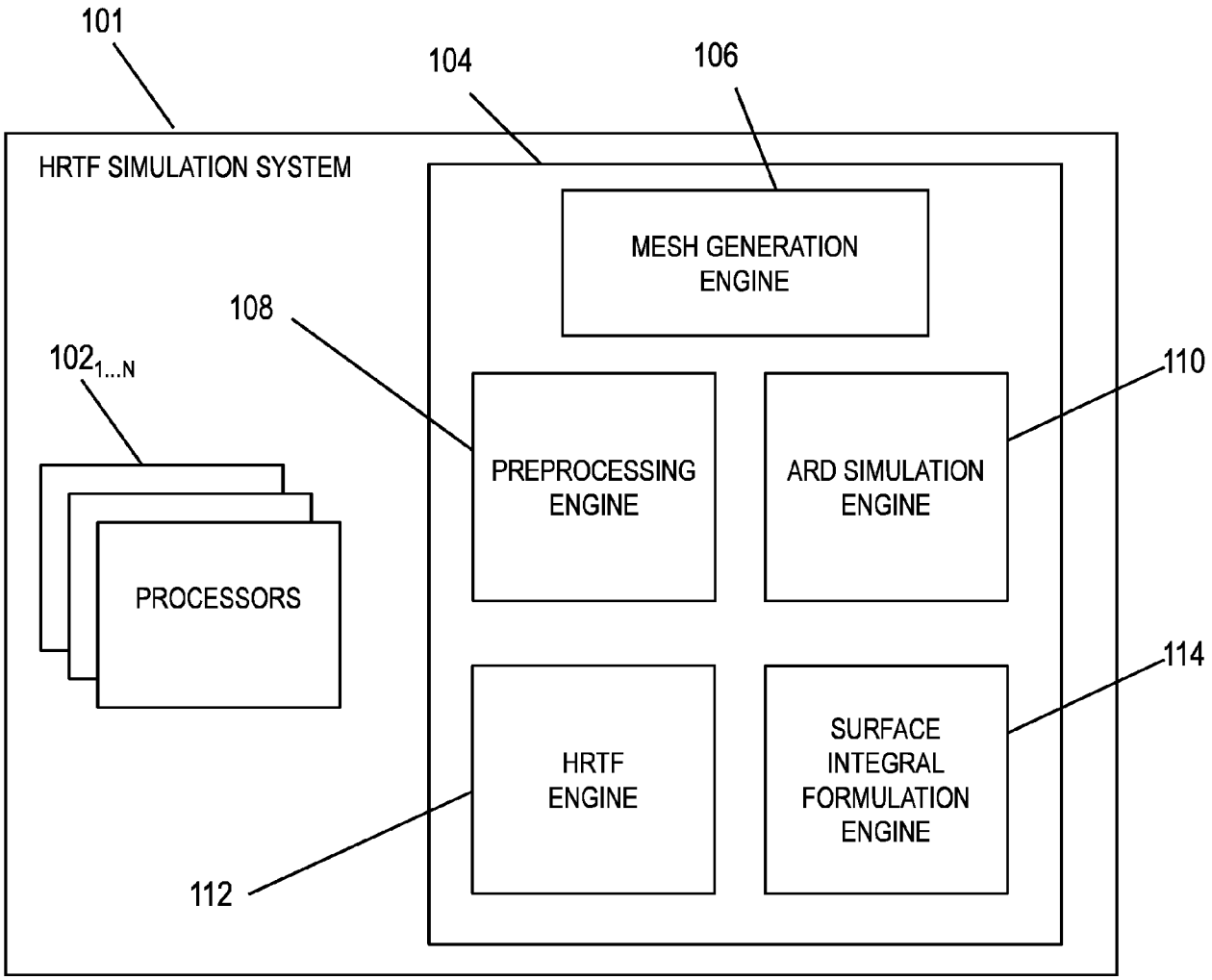
FIG. 1 is a block diagram illustrating an exemplary system for utilizing adaptive rectangular decomposition to generate HRTFs according to an embodiment of the subject matter described herein.

The human auditory system's ability to localize the direction of incoming sound based on the sound signals received at a subject's ears is attributed to cues such as interaural time difference, interaural intensity difference and spectral modification due to the scattering of sound waves due to the body. Three dimensional sound systems often incorporate these cues into the audio rendering, which is usually accomplished through the use of head related transfer functions (HRTFs).

A significant challenge involving the use of HRTFs is the variation of head, pinna and torso geometries, and the corresponding variation in HRTFs across different individuals. The HRTF measurement techniques that have been traditionally used to obtain personalized HRTFs often require the use of specialized, expensive equipment as well as tedious processes where subjects must remain still for long periods of time. As a result, personalized HRTFs of individuals are very rarely available and virtual auditory displays usually resort to using generic HRTFs. The use of such non-personalized HRTFs can lead to problems, such as lack of externalization, front-back confusions and reversals, incorrect elevation perception, and overall unconvincing spatializations. These difficulties have motivated the need to develop efficient techniques to obtain personalized HRTFs for individuals.

One approach to solving this technical problem is based on the notion that HRTF measurement can be considered to be an acoustic scattering problem in free-field. Given the 3D mesh model of a human body and its acoustic properties, numerical sound simulation techniques can be used to compute HRTFs. Techniques such as the boundary element method and the finite-difference time-domain method may be used to compute HRTFs. The accuracy of these computed HRTFs has been demonstrated by comparing them with measurements. However, these techniques are computationally expensive and can take several hours or days to process.

In some embodiments, the disclosed subject matter presents an efficient technique for computing personalized HRTFs using a numerical simulation technique called adaptive rectangular decomposition (ARD). To reduce computation time, the disclosed system and technique may be configured to use of the acoustic reciprocity principle to reduce number of simulations required and the Kirchhoff surface integral representation (KSIR) to reduce the size of the simulation domain. In some instances, embodiments of the disclosed system and technique may only require approximately 20 minutes of simulation time to compute broadband HRTFs on an eight-core computing device machine compared to hours or days needed by other techniques. Further, the accuracy of the presented approach may be analyzed by computing the left-ear HRTF of the Fritz and KEMAR manikins. For example, the mean spectral mismatch between the HRTF computed by the pipeline disclosed in the subject matter and measurements was 3.88 dB for Fritz and 3.58 dB for KEMAR, within a linear frequency range from 700 Hz to 14 kHz.

The subject matter described herein discloses methods, systems, and computer readable media for utilizing adaptive rectangular decomposition (ARD) to generate head-related transfer functions (HRTFs). Reference will now be made in detail to exemplary embodiments of the subject matter described herein, examples of which are illustrated in the accompanying drawings. Wherever possible, the same reference numbers will be used throughout the drawings to refer to the same or like parts.

FIG. 1 is a block diagram illustrating an HRTF simulation system 101 for generating at least one HRTF that is customized for a listener entity according to an embodiment of the subject matter described herein. As used herein, a listener entity may include a human listener or a virtual listener entity. HRTF simulation system 101 may be any suitable entity (e.g., such as a computing device or platform) for generating a mesh model of head and ear geometry and/or generating an HRTF using a mesh model input and ARD simulation. In accordance with embodiments of the subject matter described herein, components, modules, engines, and/or portions of HRTF simulation system 101 may be implemented in a single computing device or platform, or alternatively distributed across multiple devices or computing platforms.

In some embodiments, HRTF simulation system 101 may comprise a special purpose computing platform that includes a plurality of processors $\mathbf{102}_{1 \ldots N}$ that make up a central processing unit (CPU) cluster. In some embodiments, each of processors 102 may include a processor core, a physical processor, a field-programmable gateway array (FPGA), an application-specific integrated circuit (ASIC), and/or any other like processing unit. Each of processors $\mathbf{102}_{1 \ldots N}$ may include or access memory 104 in HRTF simulation system 101, such as for storing executable instructions and/or software based constructs. Memory 104 may be any non-transitory computer readable medium and may be operative to communicate with processors 102. Memory 104 may include and/or store a mesh generation engine 106, preprocessing engine 108, an ARD simulation engine 110, an HRTF engine 112, and/or a surface integral formulation engine 114. The functions executed by engines 106-114 are described in greater detail below.

It will be appreciated that FIG. 1 is for illustrative purposes and that various components, their locations, and/or their functions may be changed, altered, added, or removed. For example, some engines and/or functions may be combined into a single entity.

Figure 2:
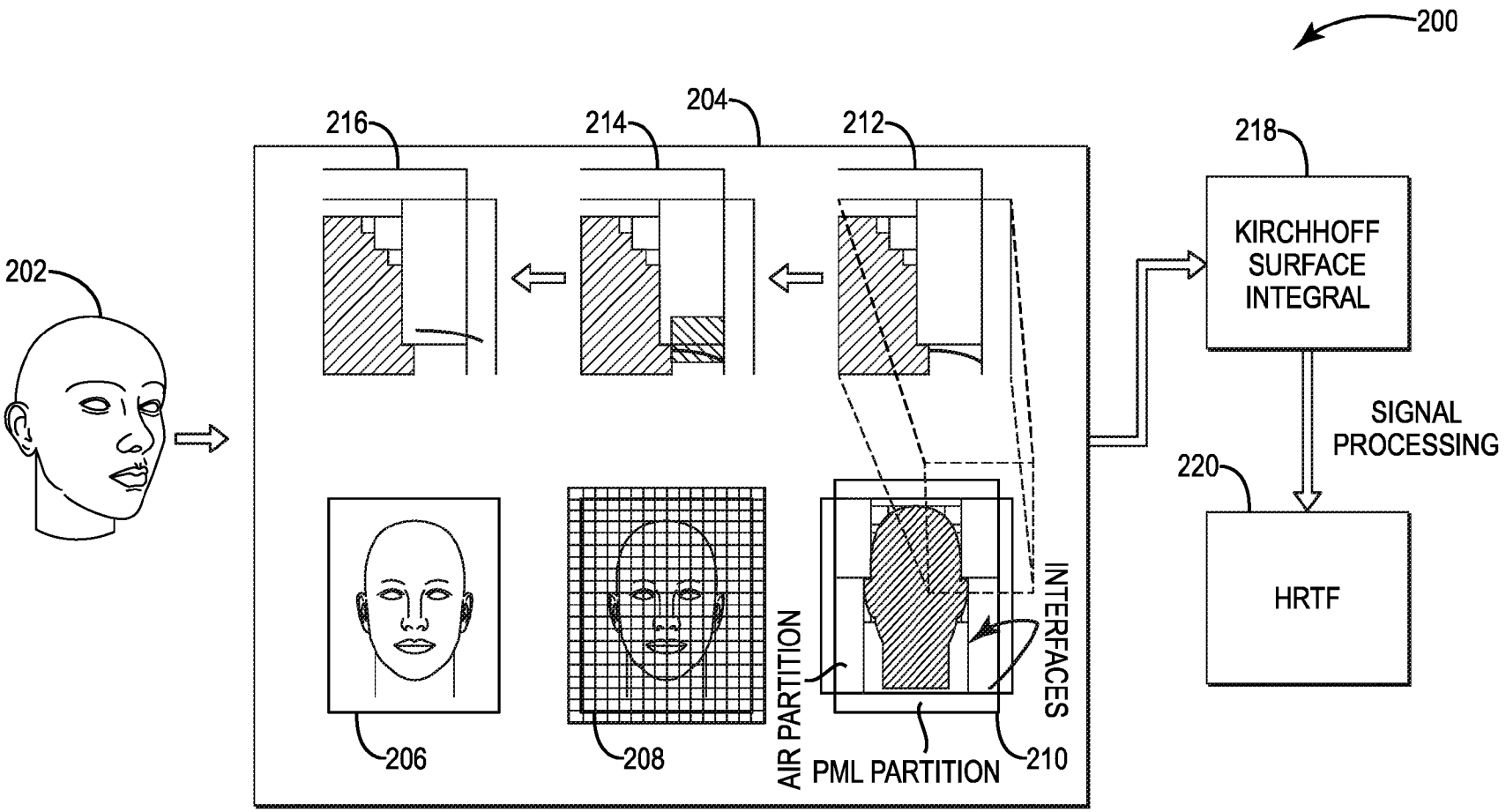
FIG. 2 is a block diagram illustrating an exemplary HRTF computational pipeline according to an embodiment of the subject matter described herein.

FIG. 2 is a block diagram illustrating an exemplary HRTF computational pipeline process that may be supported and/or executed by system 101. In some embodiments, a 3D mesh model 202 of the head and/or torso of a listener entity/subject is available as input (e.g., a mesh model generated by mesh generation engine 106, or a mesh model generated by a 3D scanning device) for system 101. Embodiments and/or exemplary techniques in which a mesh model may be generated and/or acquired is described in detail below in FIG. 3. In general, system 101 utilizes ARD to perform a sound propagation simulation by solving the acoustic wave equation (see equation 3 below). In some embodiments, ARD may be utilized to divide a simulation domain into grid cells and compute sound wave pressure at each of those grid cells at each time step Compared to finite difference based methods, ARD has much less numerical dispersion error and exhibits the technical advantage of being up to two orders of magnitude faster for homogeneous media. The principle behind ARD's efficiency and accuracy is the use of the exact numerical solution of the acoustic wave equation within rectangular (e.g., cuboidal) domains comprising an isotropic, homogeneous, dissipation-free medium.

For example, in the domain preprocessing stage 206 shown in FIG. 2, system 101 may be configured to initiate the ARD simulation process by generating a rectangular (e.g., cuboidal in three dimensions) decomposition of the computation domain. In some embodiments, this decomposition is generated via preprocessing engine 108 in a series of steps. First, the domain is voxelized to generate a grid of voxels by preprocessing engine 108.

In some embodiments, two ARD simulations (e.g., a simulation for each of the left ear and the right ear) are then executed by ARD simulation engine 110 using this simulation domain. Notably, the principle of acoustic reciprocity is used to reverse the role (and/or position) of source and receivers. For example, the aforementioned receiver positions are designated and used by ARD simulation engine 110 as source positions for these simulations, while the original source positions are designated and used by ARD simulation engine 110 as receiver positions. To prevent reflections from domain boundaries, the simulation domain generated by preprocessing engine 108 is surrounded by perfectly absorbing layer.

The simulations generated by ARD simulation engine 110 produce pressure signals at each grid cell within the simulation domain, including the KSIR surface. The pressure signals at the KSIR surface are used as input by the Kirchhoff surface integral formulation (e.g., executed by surface integral formulation engine 114) to generate pressure signals at the reciprocal receiver positions. These signals are the pressure responses at the ear positions due to the original sources around the head. The signals are then used (e.g., processed and/or executed) by HRTF engine 112 to compute HRTFs using the following equations:

$$H_L(\theta, \phi, \omega) = \frac{X_L(\theta, \phi, \omega)}{X_C(\theta, \phi, \omega)} \tag{1}$$

$$H_R(\theta, \phi, \omega) = \frac{X_R(\theta, \phi, \omega)}{X_C(\theta, \phi, \omega)}, \tag{2}$$

where $X_L(\theta,\phi,\omega)$ and $X_R(\theta,\phi,\omega)$ respectively represent the Fourier transforms of the left-ear and right-ear time-domain pressure signals for the original source at azimuth $\theta$ and elevation $\phi$, and $X_C(\theta,\phi,\omega)$ is the Fourier transform of the signal received at the point of origin due to the same source in the absence of the listener, all in free-field conditions.

In general, system 101 (and/or simulation engine 110) utilizes ARD, which is a numerical simulation technique that performs sound propagation simulation by solving the acoustic wave equation (see equation 3 below). Like finite difference based methods, system 101 utilizes ARD to divide the simulation domain into grid cells and computes sound pressure at each of those grid cells at each time step. However, compared to finite-difference-based methods, ARD processing conducted by system 101 has the technical advantage of having a much lower numerical dispersion error while being at least an order of magnitude faster. The principle behind ARD's efficiency and accuracy is system 101's use of the exact analytical solution of the wave equation within cuboidal domains comprising of a homogeneous, dissipation-free medium:

$$p(x, y, z, t) = \sum_{i=(i_x,i_y,i_z)} m_i(t)\cos\left(\frac{\pi i_x}{l_x}x\right)\cos\left(\frac{\pi i_y}{l_y}y\right)\cos\left(\frac{\pi i_z}{l_z}z\right), \tag{3}$$

where p(x,y,z,t) represents the pressure field (or sound signal) at position (x,y,z) and at time t, $(l_x,l_y,l_z)$ are the extents of the cuboidal region, and $m_i(t)$ are time-varying mode coefficients. As this solution is composed of cosines, ARD (e.g., as executed by system 101) uses efficient Fast Fourier Transform (FFT) techniques to compute sound propagation within the cuboidal region. Below, each stage and/or engine of the HRTF computational pipeline executed by system 101 is described in detail.

In some embodiments, preprocessing engine 108 in system 101 may be configured to receive a mesh model (e.g., mesh model 202) generated by mesh generation engine 106 and subsequently establish a simulation domain of the mesh model. In other embodiments, the mesh model may be generated through other techniques, such as the use of a 3D scanner device. Description of mesh generation/acquisition techniques performed by mesh generation engine 106 is described below and illustrated in FIG. 3. Preprocessing engine 108 may be configured to execute a preprocessing stages (shown in FIG. 2) including a domain stage 206, voxelization stage 208, and rectangular decomposition stage 210. For example, preprocessing engine 108 may establish a simulation domain utilizing a mesh model 202 as input. In some embodiments, a 3D mesh (e.g., mesh model 202) of the head and torso is positioned by preprocessing engine 108 at the center of an empty cuboidal simulation domain. Preprocessing engine 108 may construct an offset surface around the head of mesh model 202 to serve as a KSIR surface. The size of this domain is selected by preprocessing engine 108 such that the domain closely fits the head and torso mesh model 202, as well as a cuboidal KSIR surface surrounding the head. A point close to each of the blocked ear canal entrances of the mesh model 202 may be designated by preprocessing engine 108 as the receiver positions for the HRTF computation. Further, the source positions are uniformly selected by preprocessing engine 108 at a fixed distance (e.g., one meter) away from the center of the head at different orientations. After the domain is established in stage 206, the domain is voxelized (e.g., decompose the simulation domain by dividing/apportioning the simulation domain into grid cells) in stage 208 by preprocessing engine 108.

For example, preprocessing engine 108 may subsequently be configured to generate a rectangular decomposition of the computation domain. This decomposition may be conducted via preprocessing engine 108 in a series of steps or stages. First, the domain is voxelized to generate a grid of voxels by preprocessing engine 108 (see stage 208). Preprocessing engine 108 may subsequently group the voxels (e.g., grid cells) into the plurality of partitions that include air partitions and perfectly matched layer (PML) partitions, which are separated and/or delineated by interfaces. More specifically, preprocessing engine 108 may subsequently group different voxels and/or grid cells together to form cuboidal regions called air partitions. Boundary conditions are established by preprocessing engine 108, which uses the PML partitions at the boundary to simulate both partially-absorbing and completely-absorbing surfaces. In other embodiments, the air partitions are formed by preprocessing engine 108, which is configured to group the voxels containing the isotropic, homogeneous, dissipation-free medium (e.g., air) together to form rectangular regions (i.e., air partitions). Finally, absorbing boundary conditions are applied by preprocessing engine 108, which uses PML partitions at the boundary to simulate free-field conditions (e.g., as indicated by the HRTF definition).

After the rectangular decomposition processing is conducted by preprocessing engine 108, ARD simulation engine 110 may be configured to conduct an ARD simulation on the plurality of partitions to generate simulated sound pressure signals within each of the plurality of partitions. Furthermore, ARD simulation engine 110 may execute a simulation process that includes using finite difference stencils to propagate sound across the interfaces of adjacent partitions. More specifically, ARD simulation engine 110 may be configured to initiate a number of simulation stages (e.g., current field stage 212, an interfacing handling and discrete cosine transform (DCT) stage 214, and an inverse DCT (IDCT) and modal update stage 216 shown in FIG. 2).

At current field stage 212, ARD simulation engine 110 processes different fields (or portions) of the rectangular decomposed simulation domain. For each of the different fields, ARD simulation engine 110 conducts an interface handling stage 214 in which finite-difference stencils are used to propagate sound across adjacent partitions. In some embodiments, interface handling stage 214 may involve ARD simulation engine 110 being used to propagate sound across two adjacent partitions, which can be either air-air partitions or air-PML partitions.

After conducting stage 214, ARD simulation engine 110 updates the time varying mode coefficients for each air partition based on the acoustic wave equation to propagate sound within partitions and subsequently updates pressure values for each PML partition based on the acoustic wave equation to propagate sound within the plurality of partitions. In some embodiments, ARD simulation engine 110 performs the modal update step by propagating sound within each air partition by updating FFT mode coefficients.

As previously mentioned, HRTFs are functions of source position and require multiple separate recordings of the signal at the ears due to different sound sources placed around the listener. Replicating this process through simulation typically requires multiple separate simulations, one for each source position (e.g., usually in the hundreds). In contrast, system 101 effectively avoids this cost by employing the acoustic reciprocity principle, which provides that the acoustic response remains the same if the sense (e.g., positioning) of source and receiver are reversed. Thus, sources are placed at the receiver positions (e.g., inside the ears) used in HRTF measurement. Similarly, receivers are placed at the various source positions used in HRTF measurement. Thus, system 101 effectively reduces the required number of simulations to only two, one for each ear.

In some embodiments, ARD simulation engine 110 may be further configured to modify the simulation domain of the mesh model to improve processing. For example, ARD simulation engine 110 may utilize surface integration formulation engine 114 to compute (e.g., using a surface integral representation, such as a Kirchhoff surface integral representation) a pressure value at a point outside of the simulation domain using pressure values on a cuboidal surface closely fitting the mesh model. Only pressure values at this surface need be computed by ARD simulation engine 110, thereby reducing the size of the simulation domain as well as computational costs. As a result, surface integration formulation engine 114 and/or ARD simulation engine 110 may output a set of responses that correspond to the mesh model's scattering of Gaussian impulse sound that can be provided to HRTF engine 112 for processing.

In some embodiments, HRTFs may be measured at a fixed distance from the center of the head of the subject. Therefore, in order to compute the full HRTF as described above, a simulation domain with a radius equal to this distance may be used. This distance is usually around 1.0 m (which is much greater than the typical size of the head), due to which the simulation domain is mostly empty as the size of the head and torso is relatively small. Since computation time required by ARD scales cubically with simulation domain dimension, this can lead to large computation times. To reduce the size of the simulation domain, surface integral formulation engine 114 may be configured to make use of the Kirchhoff surface integral representation (KSIR). By using KSIR, surface integral formulation engine 114 may be enabled to conduct the computation of pressure values outside the simulation domain by using pressure values at a tight-fitting surface that encloses the head and torso, resulting in a significantly smaller simulation domain and faster simulations. Notably, surface integral formulation engine 114 can be used to compute the pressure value at a point outside a simulation domain using pressure values on a cuboidal surface closely fitting the mesh. Thus, only pressure values at this surface need to be computed by system 101 and/or surface integral formulation engine 114, thereby significantly reducing the size of the domain as well as the computational cost.

After ARD simulation engine 110 generates simulated sound pressure signals within each of the plurality of partitions of the simulation domain, surface integration formulation engine 114 processes the simulated sound pressure signals. The sound pressure signals (e.g., represented as Fourier transforms of sound waves) are subsequently provided to HRTF engine 112, which may then perform digital signaling processing (DSP). In some embodiments, these HRTFs utilize Fourier transforms of sound pressure signals received at the entrance of the listening entity's left and right blocked ear canals as input variables. In such a scenario, the HRTFs are able to represent the sound signals from a signal as affected by the listener's body (particularly the head, torso, and pinnae of the ear(s) embodied in the mesh model) as measured at the entrance of the listener's ear canals. In addition, HRTF engine 112 may be further configured to determine head related impulse responses (HRIRs) respectively associated to the calculated HRTFs by performing and/or applying an inverse Fourier transform (IFT) on the HRTFs.

For example, ARD simulation engine 110 may be configured to utilize Gaussian impulse sources in the ARD simulations. As such, the output of the KSIR calculation conducted by surface integral formulation engine 114 include a set of responses that correspond to the mesh model's (e.g., head mesh) scattering of Gaussian impulse sound. In order to convert these Gaussian impulse responses to HRIRs, ARD simulation engine 110 utilizes a digital signal processing script that implements equations 1 and 2 presented above. For example, the frequency response of the Gaussian impulse signal at the center of the head in the absence of the head (e.g., $X_C(\theta,\phi,\omega)$ in equation 1) is removed from the head responses by this script in the frequency domain, and the HRIR is obtained by ARD simulation engine 110 performing an inverse Fourier transform.

Lastly, in order to perform spatial sound rendering using HRTFs, three steps may be be performed by HRTF engine 112: (a) compute direction of incoming sound field at listener position, (b) model scattering of sound around the listening entity's head using HRTFs, and (c) incorporate listening entity's head orientation. To compute the direction of the incoming sound field at the listener position, system 101 and/or HRTF engine 112 may utilize a plane wave-decomposition approach that uses high-order derivatives of the pressure field at the listener position to compute the plane wave-decomposition of the sound field at interactive rates. Scattering of sound around the head is modeled using the personalized HRTFs computed by HRTF engine 112. Further, HRTF engine 112 may be configured to convert the HRTFs into spherical harmonic basis. By doing this, the listening entity's head rotation can be easily modeled by HRTF engine 112 using standard spherical harmonic rotation techniques. In some embodiments, the spatial sound for each ear can be computed by HRTF engine 112 as a simple dot product of the spherical harmonic coefficients of the plane-wave decomposition and the HRTF. This enables system 101 to generate spatial sound at interactive rates.

Figure 3:
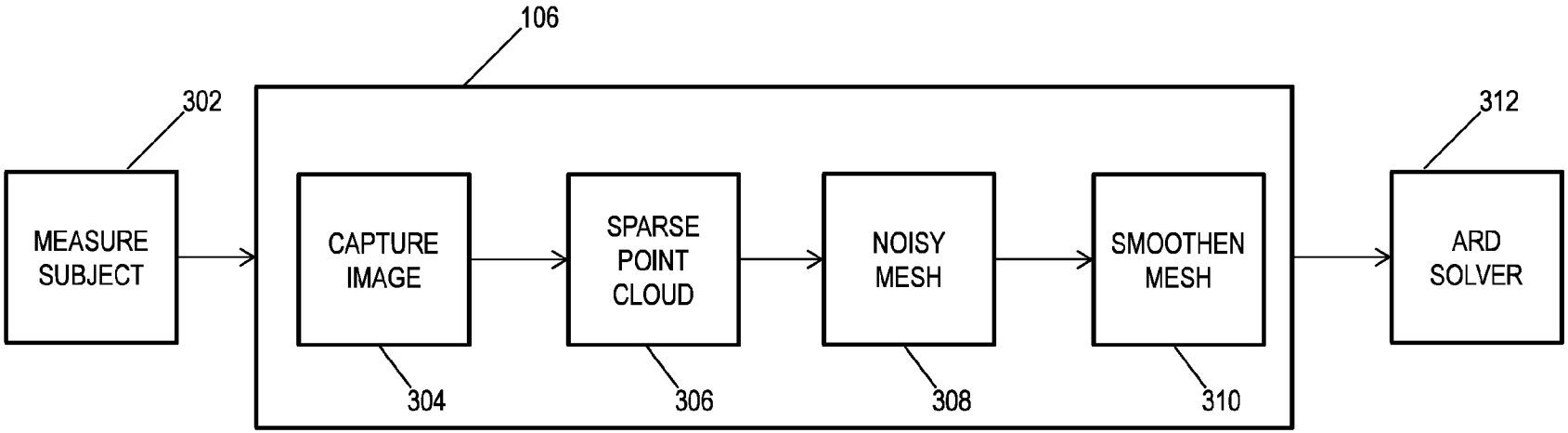
FIG. 3 is a block diagram illustrating an exemplary mesh model acquisition pipeline according to an embodiment of the subject matter described herein.

FIG. 3 is a block diagram illustrating an exemplary mesh model acquisition pipeline executed by mesh generation engine 106 according to an embodiment of the subject matter described herein. In some embodiments, mesh model 202 depicted in FIG. 2 is generated as output of mesh generation engine 106 depicted in FIG. 3. For example, engine 106 may execute a processing pipeline that includes capturing images (stage 304) of a subject (e.g., listening entity), determining a sparse point cloud (stage 306), generating a noisy mesh model (stage 308), and smoothening the mesh model (stage 310). The mesh model produced as a result from executing stages 304-310 is subsequently sent to an ARD solver 312 (e.g., preprocessing engine 108 in FIG. 1) by mesh generation engine 106.

In some embodiments, mesh generation engine 106 may be configured to generate a 3D mesh model of the head and ear geometry of a listener entity. For example, in stage 304, images of the listener entity's head and ears may be digitally captured (e.g., via a camera and/or video capture device) and subsequently provided to mesh generation engine 106 (e.g., as a set of digital files). In stage 306, mesh generation engine 106 may subsequently perform a Structure-from-Motion process that correlates the captured set of images using one or more distinctive features present in the images. Mesh generation engine 106 may be further configured to generate a sparse point cloud comprising of 3D locations of those distinctive features. In some embodiments, mesh generation engine 106 may be configured to process a set of captured images and compare any neighboring images to each other in order to identify a small set of distinctive "features" (e.g., freckle, mole, scar, etc.) that appear in at least two of the capture images. In some embodiments, multiple images that include a specific feature are taken at different angles (e.g., which are close to each other and can be used to identify the common feature). Notably, the specific feature that is common to the images may be used by mesh generation engine 106 to correlate the multiple images taken.

Next, in stage 308, mesh generation engine 106 may then perform dense modeling of the listener's head and ear geometry based on the sparse point cloud generated by stage 306 as well as the captured images in order to generate a mesh. For example, mesh generation engine 106 may be configured to utilize the sparse point cloud and the camera positions to initiate the generation of a denser mesh that combines all the rest of the parts of the images.

Mesh generation engine 106 may also be configured to apply various mesh cleanup steps (e.g., stage 310) on the mesh model prior to sending the mesh model to preprocessing engine 108 and/or ARD simulation engine 110 for further processing.

In other embodiments involving the generation of personalized HRTFs, mesh generation engine 106 may be configured to obtain accurate head and ear geometry of the user (e.g., stage 302). To facilitate easy acquisition and a highly accurate mesh model, system 101 may also be configured to use digital cameras for the acquisition of the head and ear geometry of the listener entity (e.g., stage 304). In some embodiments, images may be captured by a digital SLR camera (e.g., Canon 60D) with image resolution (3456×2304) and provided to mesh generation engine 106 as input. Such resolution allowed for observing details of the skin texture, which were leveraged by multi-view stereo estimation modules to determine reliable dense correspondences.

In some embodiments, in order to model the area of the head behind the ear (e.g., a critical area for computation of personalized HRTFs), the user may wear concealing headgear (e.g, a swim cap) to hide his or her hair during the data capture. For precise modeling, the user's (e.g., listening entity) head was densely captured all around with samples at approximately every 15 degrees. The selected angular separation between captures affords at least three samples within a 30 degree range, which enables both robust feature matching and precise geometric triangulation. Moreover, this sampling provides sufficient overlap between the views to enable high-accuracy multi-view stereo estimation. Empirically, it was found that sampling intervals larger than 15 degrees may introduce severe aberrations into the resulting 3D model. To increase the model resolution around the ear, 20 or more convergent close-up shots/images were captured for each ear. From the captured images SIFT features were calculated and matched for each image with its top K appearance nearest neighbors, as measured by the GIST descriptor. Using these matches, a structure from motion algorithm was leveraged to perform the incremental structure from motion and bundle adjustment using the cameras internal calibration as provided by the EXIF data of the images. This step provided for the camera registration needed for the dense modeling of the scene.

In some embodiments, dense modeling of the user's head may be performed by mesh generation engine 106 to obtain the desired mesh model required to compute personalized HRTFs. Using a two tier computation that first estimates two-view depths maps was opted. Besides limited accuracy from two view depth maps, highlights on the user's skin occur naturally, which can cause erroneous geometry. In some embodiments, mesh generation engine 106 may further perform smoothening processing on the mesh model (e.g., stage 308). For example, the two view depth maps may be combined by a depth map fusion performed by engine 106, which rejects the erroneous geometry resulting from highlights and produces a noisy mesh model In some embodiments, mesh generation engine 106 may be configured to apply a 3D Delaunay triangulation of dense point clouds and the construction of a graph based on the tetrahedrons from the Delaunay triangulation with weights set according to camera-vertex ray visibility. Mesh generation engine 106 may further refine the graph's t-edge weights and obtain a water-tight dense surface mesh by using a graph-cut based labeling optimization to label each tetrahedron as inside or outside.

Before the generated surface mesh is used as input for the processing pipeline 200 shown in FIG. 2, mesh generation engine 106 may perform some mesh cleanup steps in stage 310. First, since the generated mesh may not be to scale with the subject, mesh generation engine 106 may use the subject's measured head width and head depth (e.g., anthropometric measurements) to scale the generated mesh model. Next, mesh generation engine 106 may be configured to remove stray vertices and triangles from the main head mesh. Further, mesh generation engine 106 may also be configured to perform hole-filling using standard techniques to cover the holes existing in the mesh model. Finally, mesh generation engine 106 may align and orient the mesh model to match the alignment of the head during HRTF measurements and position the head mesh at the center of a cubical simulation domain. Notably, the cuboidal simulation domain (e.g., mesh model) is used as input for an ARD solver 312 (e.g., preprocessing engine 108 shown in FIG. 1). For example, the mesh model generated by mesh generation engine 106 may be embodied as mesh model 202, which is the input depicted in FIG. 2.

In some embodiments, in order to perform the disclosed methods and/or processes, system 101 may be configured to utilize scanned 3D mesh models of a KEMAR (e.g., with DB-60 pinnae) and/or Fritz mankin in order to generate HRTFs. Examples of pertinent simulation parameters that may be utilized by system 101 include the speed of sound within the homogeneous, dissipation-free medium of ARD simulation, which can be set to 343 $ms^{-1}$ to match that of air.

In some embodiments, second-order finite-difference stencils may be used in ARD for interface handling. The maximum simulation frequency for ARD can be set to 88.2 kHz, to have a small grid cell size of 1.94 mm. A Gaussian impulse source with a center frequency of 33.075 kHz can be used as source signal. The absorption coefficient of the mesh surface may be set to 0.02 to correspond to that of human skin. In some embodiments, simulations can be run to generate 5.0 ms pressure signals.

Figure 4:
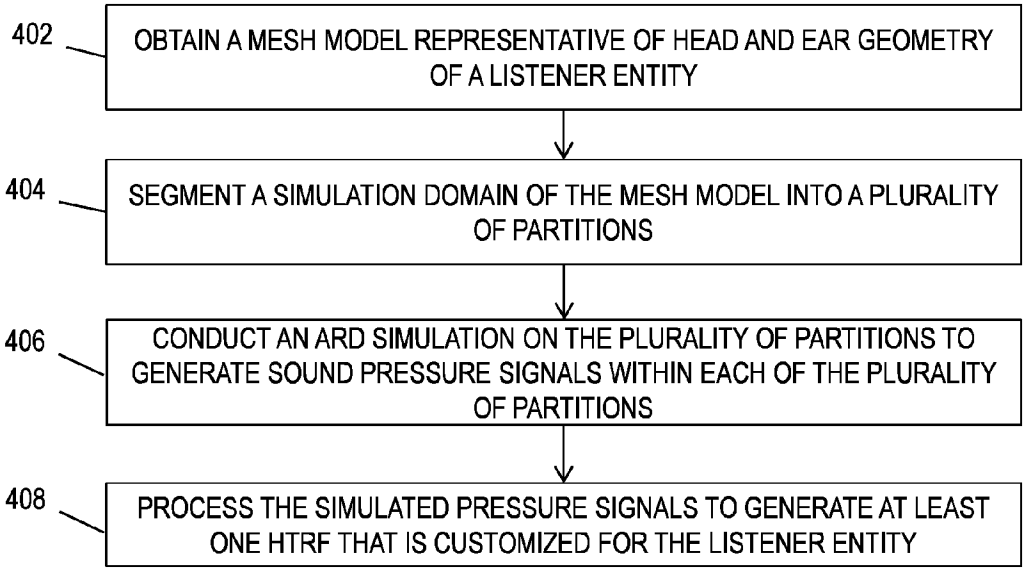
FIG. 4 is a diagram illustrating a flow chart of an exemplary method for utilizing adaptive rectangular decomposition to generate head-related transfer functions according to an embodiment of the subject matter described herein.

FIG. 4 is a diagram illustrating a flow chart of an exemplary method 400 for utilizing adaptive rectangular decomposition to generate head-related transfer functions according to an embodiment of the subject matter described herein. In block 402, a mesh model that is representative of head and ear geometry of a listener entity is obtained. For example, preprocessing engine 108 may be provided with a closed, accurate 3D mesh model of the head and torso of a listener entity/subject. In some embodiments, the mesh model may be created by mesh generation engine 106 in the manner described above.

In block 404, a simulation domain of the mesh model is segmented into a plurality of partitions. In some embodiments, preprocessing engine 108 uses the mesh model to generate a simulation domain that is subsequently voxelized into grid cells. Preprocessing engine 108 may subsequently group the grid cells into air partitions and/or PML partitions by performing a rectangular decomposition procedure.

In block 406, an ARD simulation is conducted on the plurality of partitions to generate simulated sound pressure signals within each of the plurality of partitions. In some embodiments, ARD simulation engine 110 utilizes the plurality of partitions as constituent rectangles subjected to a sound wave equation. Notably, ARD simulation engine 110 is able to determine the analytical solution of the sound wave equation in any rectangular domain. More specifically, since the spatial portion of the solution of the wave equation is composed of cosines, ARD simulation engine 110 may use a discrete cosine transform to obtain a simulation of the sound wave within a rectangular domain. ARD simulation engine 110 may also employ interfacing handling techniques to process (e.g., simulate) how a sound wave propagates across a boundary/interface between two partitions/rectangles. Using the above information, ARD simulation engine 110 is able to simulate sound pressure signals (e.g., Fourier Transforms of sound pressure waveforms) within each of the plurality of partitions.

In block 408, the simulated sound pressure signals are processed to generate at least one HRTF that is customized for the listener entity. In particular, HRTF engine 112 may receive the sound pressure signal as Fourier transform representations and calculate at least one HRTF. For example, HRTF engine 112 may receive i) Fourier transforms of the left-ear and right-ear time-domain sound pressure signals and ii) the Fourier transform of the signal received at the origin of the mesh model due to the same source in the absence of the listener and compute the HRTFs for the left and right ears using equations (1) and (2) listed above.

It should be noted that HRTF simulation system 101 and/or functionality described herein can constitute a special purpose computing system. Further, HRTF system 101, engines 106-112, and/or functionality described herein provides improvements toward the technological field of acoustic simulation. In particular, HRTF simulation system 101 presents a novel device and algorithm for performing efficient personalized HRTF computations that can be used to simulate high-fidelity spatial sound as perceived by a single listener entity. Notably, the present subject matter presents an advantageous alternative to (and/or obviates the need for) conducting physical measurements of subjects (e.g., in an anechoic chamber) to generate subject-specific HRTFs. Notably, these types of customized solutions can be both cost prohibitive and time consuming.

It will be understood that various details of the subject matter described herein may be changed without departing from the scope of the subject matter described herein. Furthermore, the foregoing description is for the purpose of illustration only, and not for the purpose of limitation, as the subject matter described herein is defined by the claims as set forth hereinafter.

What is claimed is:

1. A method for utilizing adaptive rectangular decomposition (ARD) to generate a head-related transfer function (HRTF), the method comprising:

obtaining a mesh model representative of head and ear geometry of a listener entity, wherein obtaining the mesh model includes capturing images of a head and ear geometry of the listener entity and conducting dense modeling processing on the captured images to generate a three-dimensional (3D) mesh model;

segmenting a simulation domain of the mesh model into a plurality of partitions;

conducting an ARD simulation on the plurality of partitions to generate simulated sound pressure signals within each of the plurality of partitions; and processing the simulated sound pressure signals to generate at least one HRTF that is customized for the listener entity.

2. The method of claim 1 comprising utilizing the at least one generated HRTF to render spatial sound to the listener entity.

3. The method of claim 1 wherein the at least one HRTF includes a first HRTF and a second HRTF respectively associated with a right ear and a left ear of the listener entity.

4. The method of claim 1 comprising voxelizing the simulation domain of the mesh model into grid cells, wherein the grid cells are subsequently grouped into the plurality of partitions.

5. The method of claim 1 wherein the sound pressure signals are subjected to a surface integral representation after the ARD simulation.

6. The method of claim 1 wherein at least one head-related impulse response (HRIR) customized for the listener entity is determined by applying an inverse Fourier Transform (IFT) to the at least one generated HRTF.

7. A system for utilizing adaptive rectangular decomposition (ARD) to perform head-related transfer function (HRTF) simulations, the system comprising:

a processor;

a preprocessing engine executable by the processor, wherein the preprocessing engine is configured to obtaining a mesh model representative of head and ear geometry of a listener entity and segmenting a simulation domain of the mesh model into a plurality of partitions;

a mesh generation engine configured to capture images of a head and ear geometry of the listener entity and conduct dense modeling processing on the captured images to generate a three-dimensional (3D) mesh model;

an ARD simulation engine executable by the processor, wherein the ARD simulation engine is configured to conduct an ARD simulation on the plurality of partitions to generate simulated sound pressure signals within each of the plurality of partitions; and an HRTF engine executable by the processor, wherein the HRTF engine is configured to process the simulated sound pressure signals to generate at least one HRTF that is customized for the listener entity.

8. The system of claim 7 wherein the preprocessing engine is further configured to utilize the at least one generated HRTF to render spatial sound to the listener entity.

9. The system of claim 7 wherein the at least one HRTF includes a first HRTF and a second HRTF respectively associated with a right ear and a left ear of the listener entity.

10. The system of claim 7 wherein the ARD simulation engine is further configured to voxelize the simulation domain of the mesh model into grid cells, wherein the grid cells are subsequently grouped into the plurality of partitions.

11. The system of claim 7 wherein the sound pressure signals are subjected to a surface integral representation after the ARD simulation.

12. The system of claim 7 wherein the HRTF engine is further configured to generate at least one head-related impulse response (HRIR) customized for the listener entity is determined by applying an inverse Fourier Transform (IFT) to the at least one generated HRTF.

13. A non-transitory computer readable medium having stored thereon executable instructions that when executed by a processor of a computer cause the computer to perform steps comprising:

obtaining a mesh model representative of head and ear geometry of a listener entity, wherein obtaining the mesh model includes capturing images of a head and ear geometry of the listener entity and conducting dense modeling processing on the captured images to generate a three-dimensional (3D) mesh model;

segmenting a simulation domain of the mesh model into a plurality of partitions;

conducting an ARD simulation on the plurality of partitions to generate simulated sound pressure signals within each of the plurality of partitions; and processing the simulated sound pressure signals to generate at least one HRTF that is customized for the listener entity.

14. The computer readable medium of claim 13 comprising utilizing the at least one generated HRTF to render spatial sound to the listener entity.

15. The computer readable medium of claim 13 wherein the at least one HRTF includes a first HRTF and a second HRTF respectively associated with a right ear and a left ear of the listener entity.

16. The computer readable medium of claim 13 comprising voxelizing the simulation domain of the mesh model into grid cells, wherein the grid cells are subsequently grouped into the plurality of partitions.

17. The computer readable medium of claim 13 wherein the sound pressure signals are subjected to a surface integral representation after the ARD simulation.

* * * * *